US006796624B2

(12) United States Patent
Park

(10) Patent No.: US 6,796,624 B2
(45) Date of Patent: Sep. 28, 2004

(54) MULTIFUNCTION BOOKSHELF

(76) Inventor: Hyuk Koo Park, 801-801 Beoksan Hansung Apt., 1267 Kwonsun-dong, Kwonsun-gu, Suwon-shi, Kyonggi-do (KR)

( * ) Notice: Subject to any disclaimer, the term of this patent is extended or adjusted under 35 U.S.C. 154(b) by 61 days.

(21) Appl. No.: 09/967,941

(22) Filed: Oct. 2, 2001

(65) Prior Publication Data

US 2003/0062809 A1 Apr. 3, 2003

(51) Int. Cl.[7] ..... A47B 37/00
(52) U.S. Cl. ..... 312/313; 108/50.11
(58) Field of Search ..... 312/31.2, 31.3, 312/31.01, 31, 223.5; 108/23, 25, 26, 50.13, 50.11, 193, 161

(56) References Cited

U.S. PATENT DOCUMENTS

| | | | | | |
|---|---|---|---|---|---|
| 1,928,151 | A | * | 9/1933 | Goldman | 40/649 |
| 2,545,160 | A | * | 3/1951 | MIller | 422/305 |
| 2,773,729 | A | * | 12/1956 | Derman | 312/257.1 |
| 2,860,023 | A | * | 11/1958 | Herdlitchka | 312/31.1 |
| 3,001,638 | A | * | 9/1961 | Kuzmich | 312/244 |
| 3,759,594 | A | * | 9/1973 | Cobb | 312/31 |
| 4,148,618 | A | * | 4/1979 | Christenson et al. | 96/142 |
| 4,387,534 | A | | 6/1983 | Lewandowski et al. | |
| 4,441,143 | A | * | 4/1984 | Richardson, Jr. | 362/183 |
| 4,989,506 | A | * | 2/1991 | McCormick | 100/90 |
| 5,303,127 | A | | 4/1994 | Kosann | |
| 5,687,581 | A | | 11/1997 | Price | |
| 5,689,726 | A | | 11/1997 | Lin | |
| 5,709,736 | A | * | 1/1998 | Fujimura | 96/144 |
| 6,006,903 | A | * | 12/1999 | Milone | 206/204 |
| 6,102,548 | A | * | 8/2000 | Mantle et al. | 362/155 |
| 6,402,338 | B1 | * | 6/2002 | Mitzel et al. | 362/154 |

FOREIGN PATENT DOCUMENTS

| | | |
|---|---|---|
| DE | 41 20 182 A | 6/1991 |
| DE | 201 05 816 U | 4/2001 |

* cited by examiner

*Primary Examiner*—Janet M. Wilkens
(74) *Attorney, Agent, or Firm*—McDermott, Will & Emery

(57) ABSTRACT

A multifunctional bookshelf, the bookshelf including an upper plate, a lower plate and a plurality of middle plates, wherein the bookshelf comprises: lighting unit mounted at the upper plate to provide a lighting to a lower front side thereof; a plurality of container bodies provide at the upper plate, the lower plate and the middle plates; and insecticide, dehumidifier, deodorizer and aromatic stored in the plurality of container bodies, such that dehumidifying and insect-proof functions thereof promote the property of preservation of data stacked on shelves, stench is prevented from generation and sufficient illumination is supplied, thereby providing users pleasant environment.

4 Claims, 2 Drawing Sheets

MULTIFUNCTION BOOKSHELF

BACKGROUND OF THE INVENTION

1. Field of the Invention

The present invention relates to a bookshelf adapted to stack data such as a plurality of books in neat order to allow a user to easily select necessary data, and more particularly to a multifunctional bookshelf adapted to provide a pleasant environment to users on one hand and to provide a high conservation efficiency to the stacked data on the other hand.

2. Description of the Prior Art

Generally, bookshelves used in libraries or stack rooms of public institutions are vertically arranged panels where books and other data are inserted and stored at multi-staged space thereof, whereas no separate ventilations or dehumidifying facilities are equipped therewith, such that books or other data to be stored for a long time tend to be discolored, degenerated or damaged by vermins, thereby resulting in generation of stench.

There is another problem in that plural numbers of shelves are arranged in rows to have a plurality of books inserted thereinto, such that, unless there are special lighting systems to light the books, books or data cannot be properly distinguished or found because books or data are shaded by adjacent bookshelves.

SUMMARY OF THE INVENTION

The present invention is disclosed to solve the aforementioned problems and it is an object of the present invention to provide a multifunctional bookshelf adapted to possess dehumidifying, moth-proof functions for increase of preservation ability for data or books stacked on the shelves.

It is another object of the present invention to provide a multifunctional bookshelves adapted to provide a pleasant useability, to prevent generation of stench and to supply a sufficient lighting thereto.

In accordance with the objects of the present invention, there is provided a multifunctional bookshelf, the bookshelf including an upper plate, a lower plate and a plurality of middle plates, wherein the bookshelf comprises:

lighting means mounted at the upper plate to provide a lighting to a lower front side thereof;

a plurality of container bodies provide at the upper plate, the lower plate and the middle plates; and insecticide, dehumidifier, deodorizer and aromatic stored in the plurality of container bodies.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiment of the present invention will be described in detail with reference to the accompanying drawings.

Figure 1:
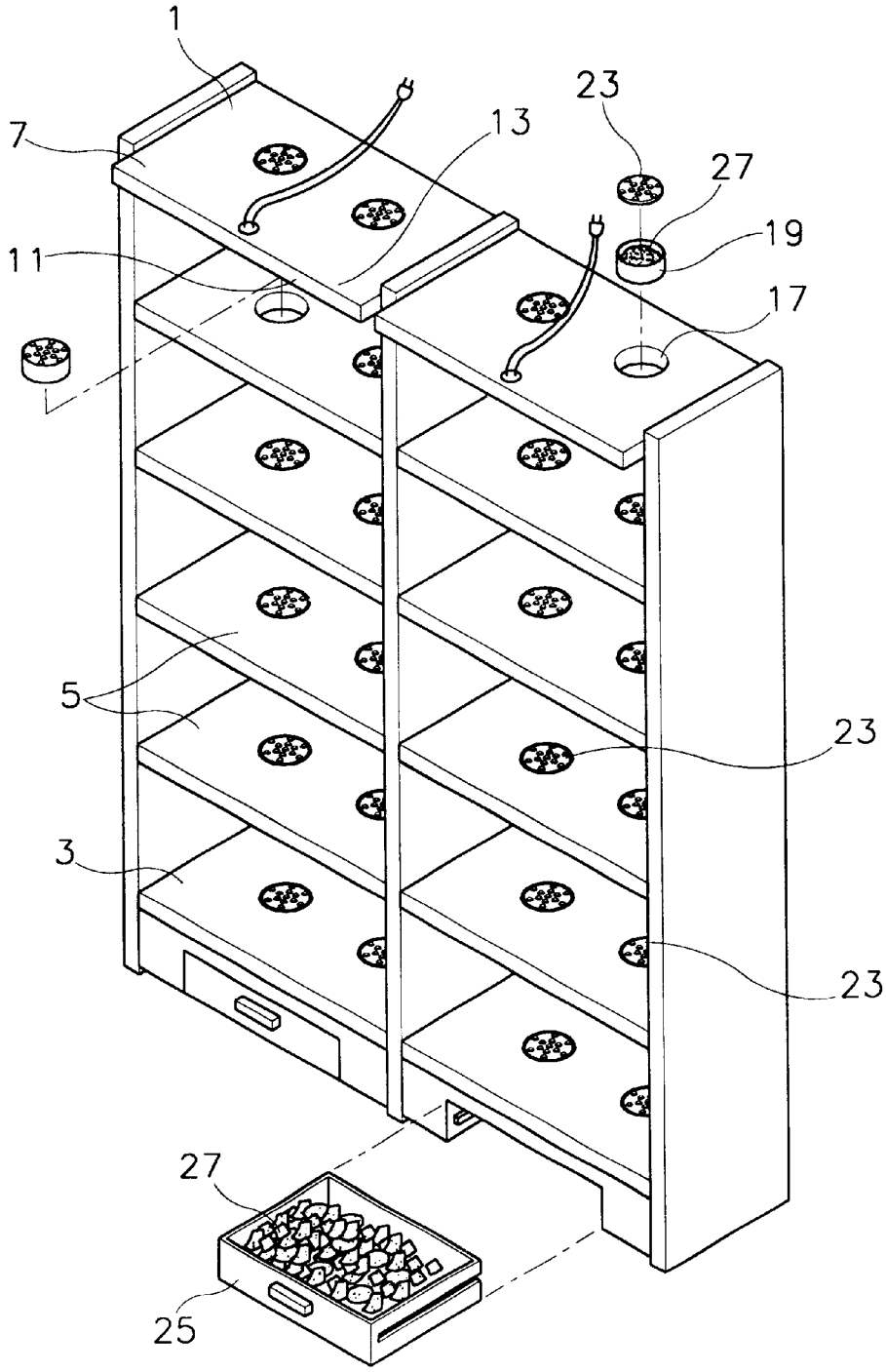
FIG. 1 is a perspective view for illustrating a multifunctional bookshelf according to the present invention.
Figure 2:
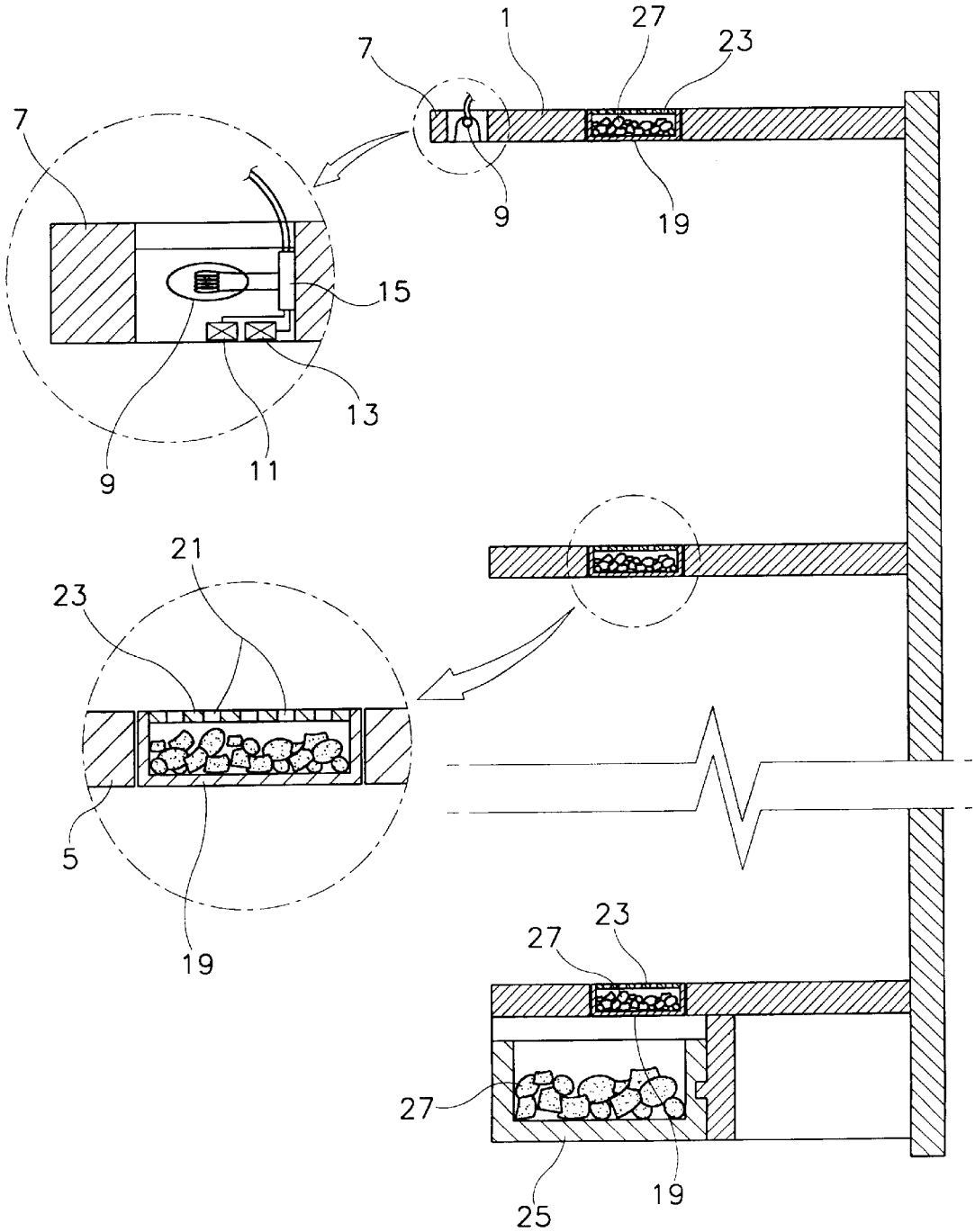
FIG. 2 is a sectional view for illustrating principal parts of FIG. 1.

FIGS. 1 and 2 are schematic drawings for illustrating a multifunctional bookshelf according to the present invention, where the bookshelf basically is composed of an upper plate 1, a lower plate 3 and a plurality of mid plates 5 for stack of a multiplicity of books.

At this location, the upper plate 1 is mounted with lighting means for providing lighting to a frontal lower side of the bookshelf, where the lighting means includes a light 9 mounted at a protruder 7 protruded to a front side of the upper late 1, an access sensor 11 for detecting whether a person is at a position near to the bookshelf, an illustration sensor 13 for measuring the degree of illumination at the bookshelf, and a controller 15 for receiving signals from the access sensor 11 and the illustration sensor 13 to control the light.

The access sensor 11, the illumination sensor 13 and the controller 15 are used as a module integrally formed with those as shown in FIG. 2 but may be respectively used at a proper position where beautiful look of the bookshelf is not hampered.

Meanwhile, the upper plate 1, the lower plate 3 and the mid plates 5 are provided with many container bodies, where each container body includes a lower body 19 to be inserted into a through hole 17 so formed as to penetrate the upper plate, the lower plate and the mid plates from up and down directions, and a multi hole copper plate 23 covered on the lower body 19 and formed with many holes.

Meanwhile, the lower plate 3 of the bookshelf is separately equipped with a container body of a drawer 25 where contents thereof can be replaced.

The plurality of container bodies thus described are provided therein with insecticide, dehumidifier, deodorant and aromatic 27 where these agents may be artificial or natural. Examples of agents that can be used as deodorant and dehumidifier include charcoal and/or active carbon.

Now, operation of the present invention thus constructed will be described.

When a user approaches a multifunctional bookshelf to search for data stacked on the shelves, the controller 15 discriminates whether the user has approached the bookshelf while the illumination sensor 13 detects a degree of illumination at the bookshelf to determine whether to light the light 9, and if necessary, lights the light 9 to illuminate the front side of the bookshelf.

As a result, the user can always search necessary data from the bookshelf at all times under the sufficient lighting.

The container bodies thus provided at the upper plate 1, the lower plate 3 and the plurality of mid plates 5 are inserted by the lower body 19 containing insecticide, dehumidifier, deodorant and aromatic 27, the lower body 19 being covered by the multi hole copper plate 23, such that data stacked or arranged on the shelves are prevented from being damaged caused by insects and humidity by physical and chemical reactions of the multi hole copper plate 23 and contents in the lower body 19, and stench is removed, thereby providing pleasant aroma and environment to the user.

Particularly, the multi hole copper plate 23 made of copper can remove stench and posses an excellent air cleaning capability, thereby cleaning polluted air in the multifunctional bookshelf.

Meanwhile, a large amount of insecticide and dehumidifier contained in the drawer 25 provided underneath the lower plate 3 also prevents insects from approaching the bookshelf, removes humidity and keeps stored data from being damaged, thereby promoting the property of preservation for the data, and specifically, the drawer 25 is loaded with a large amount of charcoal and active carbon to completely eliminate humidity coming from bottom surface of the bookshelf, enabling to obtain a perfect dehumidifying result.

Of course, the drawer 25 can be easily opened and closed, and contents such as charcoal and active carbon contained therein may be simply replaced. The container body comprising the lower plate 19 and the multi hole copper plate 23 can easily replace contents therein by opening the multi hole copper plate 23 mounted thereon.

As apparent from the foregoing, there is an advantage in the multifunctional bookshelf thus described according to the present invention in that dehumidifying and insect-proof functions are provided to promote the property of preservation of data stacked on shelves, stench is prevented from generation and sufficient illumination is supplied, thereby providing users pleasant environment.

What is claimed is:

1. A multifunctional bookshelf, the bookshelf including an upper plate, a lower plate and a plurality of middle plates, wherein the bookshelf comprises:

lighting means mounted at the upper plate to provide a lighting to a lower front side thereof;

a plurality of container bodies provided at the upper plate, the lower plate and the middle plates; and insecticide, dehumidifier, deodorizer and aromatic stored in the plurality of container bodies, wherein each of the container bodies comprises:

a lower body to be inserted into a through hole so formed as to penetrate the upper plate, the lower plate and the middle plates from up and down directions, and a multi hole copper plate formed with holes, the multi hole copper plate to be placed on the lower body to cover the insecticide, dehumidifier, deodorizer and aromatic stored therein.

2. The bookshelf as defined in claim 1, wherein the lighting means comprises:

a light mounted at a protruder protruded to a front side of the upper plate;

an access sensor for detecting whether a person is at a position near to the bookshelf;

an illumination sensor for measuring the degree of illumination at the bookshelf; and a controller for receiving signals from the access sensor and the illumination sensor to control the light.

3. The bookshelf as defined in claim 1, further comprising a drawer provided to the underneath of the lower plate to store insecticide, dehumidifier, deodorizer and aromatic, and to allow those contents to be replaced.

4. The bookshelf as defined in claim 1, wherein the dehumidifier and deodorizer are charcoal and active carbon.

* * * * *